US012768105B2

(12) United States Patent
Folnsbee

(10) Patent No.: US 12,768,105 B2
(45) Date of Patent: Oct. 20, 2026

(54) MINI-SCAN FOR DYNAMIC CORRELATION

(71) Applicant: Honeywell International Inc., Charlotte, NC (US)

(72) Inventor: Eric J. Folnsbee, Winterport, ME (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 602 days.

(21) Appl. No.: 18/199,713

(22) Filed: May 19, 2023

(65) Prior Publication Data

US 2024/0384469 A1 Nov. 21, 2024

(51) Int. Cl.
*D21G 9/00* (2006.01)

(52) U.S. Cl.
CPC ..... *D21G 9/0009* (2013.01)

(58) Field of Classification Search
CPC ..... D21G 9/0009
See application file for complete search history.

(56) References Cited

U.S. PATENT DOCUMENTS 3,729,619 A 4/1973 Laycak et al.
4,903,528 A * 2/1990 Balakrishnan ..... D21G 9/0009 73/159
4,921,574 A 5/1990 Hu
5,327,770 A 7/1994 Hindle
7,298,492 B2 11/2007 Tixier
7,695,592 B2 4/2010 Shapespeare
8,021,517 B2 9/2011 Hughes
8,527,212 B2 9/2013 Hughes et al.
9,182,360 B2 11/2015 Tixier et al.
9,309,625 B2 4/2016 Backstrom
9,891,164 B2 2/2018 Tixier
9,927,366 B2 3/2018 Tixier et al.
10,072,922 B2 9/2018 Tixier et al.
10,174,456 B2 1/2019 Backstrom
10,281,318 B1 5/2019 Lawrence
10,358,771 B2 7/2019 He
(Continued)

OTHER PUBLICATIONS

S. Lakota et al., Flatness Measurement by Multipoint Methods and by Scanning Methods, J. Interdisciplinary Research, Jul. 10, 20218.

*Primary Examiner* — Abbas Rashid
*Assistant Examiner* — Stephen M Russell
(74) *Attorney, Agent, or Firm* — Seager, Tufte & Wickhem, LLP

(57) ABSTRACT

Correlating on-line scanning sensor readings to laboratory test results for the verification of accuracy and repeatability can be facilitated by changing the scanning parameters of the scanner so that it only scans a small portion of the sheet that is to be sampled. This feature makes the sensor's mini-scan readings more relevant and more likely to be a repeatable result. The entire dynamic correlation process achieves more reliable results in a shorter length of time. A technique of operating a continuous sheet making system that includes actuators and a downstream scanning sensor, includes: (a) measuring a sheet physical characteristic of the continuous sheet with the scanning sensor and displaying a cross directional profile of the measurements; (b) selecting a cross directional region within the profile; and (c) measuring the sheet physical characteristic with the scanning sensor within the region. The results from the mini-scanned are compared to laboratory analyses.

18 Claims, 4 Drawing Sheets

(56) References Cited

U.S. PATENT DOCUMENTS

| | | | | |
|---|---|---|---|---|
| 10,501,274 | B2 | 12/2019 | Ramakrishnan | |
| 11,255,659 | B2 | 2/2022 | Hughes et al. | |
| 2004/0069059 | A1* | 4/2004 | Shakespeare | D21G 9/0009 73/159 |
| 2008/0288100 | A1* | 11/2008 | Moisio | G05B 19/41875 700/127 |
| 2009/0237749 | A1 | 9/2009 | Clouse | |
| 2017/0241078 | A1 | 8/2017 | Forbes | |
| 2020/0096308 | A1 | 3/2020 | Hughes et al. | |
| 2021/0262776 | A1 | 8/2021 | Tixier et al. | |
| 2021/0382173 | A1 | 12/2021 | Hughes et al. | |

* cited by examiner

MINI-SCAN FOR DYNAMIC CORRELATION

FIELD OF THE INVENTION

The present invention generally relates to quality control techniques for fabricating sheet materials and, more particularly, to methods facilitate correlating on-line scanning sensor readings to laboratory test results for sheet materials produced in a continuous process.

BACKGROUND OF THE INVENTION

On-line measurements are used to detect properties of sheet materials during manufacture to enable prompt control of the sheetmaking processes and, thus, to assure sheet quality while reducing the quantity of substandard sheet material which is produced. One of the main complications in making on-line measurements during sheetmaking is that the physical properties of sheet materials usually vary in the machine direction as well as in the cross direction. ("Machine direction" refers to the direction of travel of the sheet material during manufacture, and the term "cross direction" refers to the direction across the surface of a sheet perpendicular to the machine direction.)

To detect variations in sheet materials, scanning sensors are employed that periodically traverse back and forth across a sheetmaking machine in the cross direction while detecting values of a selected sheet property such as basis weight or caliper along each scan. Normally, the sheet being produced is traversed from edge to edge during each scan. The time required for a typical scan is generally between a few seconds to tens of seconds depending on the cross-direction length which can be many meters. The rate at which measurement readings are provided by such scanners is usually adjustable; a typical rate is about one measurement reading every millisecond.

In practice, measurement information provided by scanning sensors is usually assembled after each scan to provide a "profile" of the detected sheet property in the cross direction. In other words, each profile is comprised of a succession of sheet measurements at adjacent locations in the cross direction. The purpose of the profiles is to allow cross-directional variations in sheet properties to be detected easily. Based upon the detected cross-directional variations in the detected sheet property, appropriate control adjustments may be made to the sheetmaking machine with the goal of reducing profile variations both in the cross direction and in the machine direction.

A scanning sensor that periodically traverses a sheet at generally constant speed cannot measure the selected sheet property at locations which are aligned exactly perpendicular to the longitudinal edges of the sheet. Because of the sheet velocity, scanning sensors actually travel diagonally across the sheet surface, with the result that consecutive scanning paths have a zig-zag pattern with respect to the direction perpendicular to the longitudinal edges of the sheet. In practice, it is typical to calculate an average of profile measurements over each scan.

In industrial papermaking machines, which are often referred as Fourdrinier machines, the scanning sensors are periodically tested but this testing process is time consuming.

SUMMARY OF THE INVENTION

The present invention is based, in part, on the recognition that correlating on-line scanning sensor readings to laboratory test results for the verification of accuracy and repeatability can be facilitated by changing the scanning parameters of the scanner so that it only scan a small portion of the sheet that is to be sampled. This feature makes the sensor's mini-scan readings more relevant and more likely to be a repeatable result. The entire dynamic correlation process achieves more reliable results in a shorter length of time.

In one aspect, the invention is directed to a method of operating a continuous sheet making system which includes a plurality of actuators that are positioned along a cross direction and a scanning sensor, which is positioned downstream of the plurality of actuators, for measuring and acquiring property data of the moving sheet of material, that includes:

(a) measuring a sheet physical characteristic of the continuous sheet with the scanning sensor and displaying a cross directional profile of the measurements;

(b) selecting a cross directional region within the profile; and (c) measuring the sheet physical characteristic of the continuous sheet with the scanning sensor within the region. One or more of the actuators can be adjusted in response to the measurements.

In another aspect, the invention is directed to a method of correlating scanning sensor measurements to laboratory analyses that is employed in a system for manufacturing a continuous sheet product that moves in a machine direction (MD) which employs a scanning sensor that periodically traverse back and forth across the full width of the moving sheet during a production mode. The method includes:

(a) operating the scanning sensor in a production mode to periodically traverse back and forth across the full width of a sheet in the cross direction (CD) to detect values of a selected sheet property along each scan;

(b) operating the scanning sensor in a verification mode by changing the cross-directional width of each scan to be substantially less than the entire width of the sheet subject to scanning to detect values of the selected sheet property along each scan to generate the detected values;

(c) obtaining samples of the sheet of material produced during the verification mode;

(d) testing the samples obtained during the verification mode to ascertain test results; and (e) comparing the test results to the detected values obtained in the verification mode.

In a further aspect, the invention is directed to a method of measuring process variables in a continuous sheet process which has a machine direction and a cross direction, which includes:

(i) providing an elongated member that supports a mounting head comprising sensor;

(ii) activating actuators to produce a continuous sheet of material;

(iii) directing the continuous moving sheet of material along a machine direction wherein the sheet has a first edge and a second edge and wherein the first elongated member is positioned along a cross direction adjacent to the continuous moving sheet of material;

(iv) maneuvering the mounting head back and forth between a first scanning position and a second scanning position such that the sensor measures a property of the sheet between the first edge and the second edge of the sheet of material and the sensor generates first signals corresponding to the measurements;

(v) controlling the actuators in response to the first signals;

(vi) stop controlling the actuators in response to the first signals;

(vii) maneuvering the mounting head back and forth between a third scanning position and a fourth scanning position such that the sensor measures a property of the sheet between a region of the sheet of material that is within the first edge and the second edge and the sensor generates second signals corresponding to the measurements;

(viii) obtaining samples of the sheet of material produced during step (vii);

(ix) testing the samples obtained in step (viii) to obtain test results; and (x) comparing the test results to the second signals.

While the invention will be illustrated as being implemented in papermaking, it is understood that the invention is applicable in other continuous sheet making processes such as, for example, in the manufacturer of rubber sheets, plastic films, electrodes, metal foils, fabrics and the like.

DETAILED DESCRIPTION OF THE PREFERRED EMBODIMENTS

Figure 1:
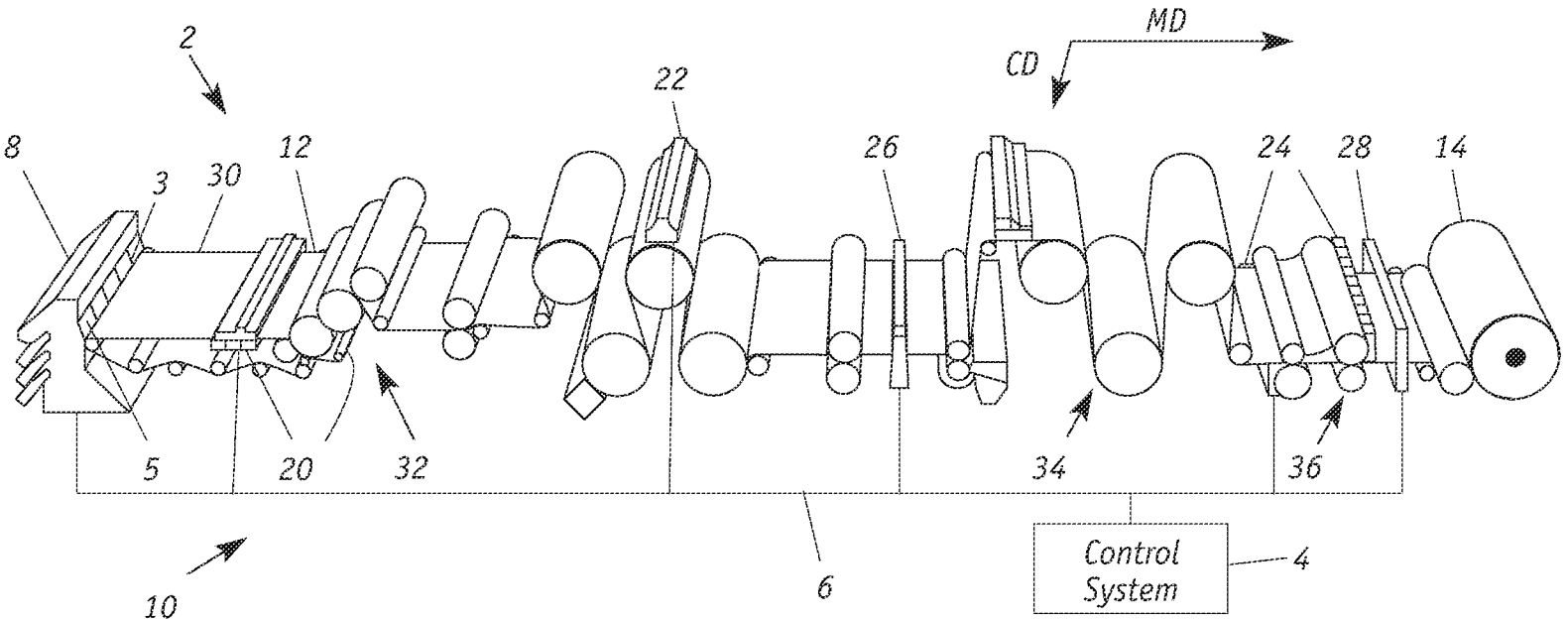
FIG. 1 is a schematic illustration of a papermaking system.

FIG. 1 illustrates a sheetmaking system 10 that includes papermaking machine 2, control system 4 and network 6. The papermaking machine 2 produces a continuous sheet of paper material 12 that is collected in take-up reel 14. The paper material 12, having a specific width, is produced from a pulp suspension feedstock, comprising of an aqueous mixture of wood fibers and other materials, which undergoes various unit operations that are monitored and controlled by a quality control system 4. The network 6 facilitates communication between the components of system 10. Papermaking is described in U.S. Pat. No. 9,309,625 to Backstrom and Forbes and U.S. Pat. No. 8,021,517 to Hughes and Tixier, which are incorporated herein by reference.

The papermaking machine 2 includes a headbox 8, which distributes an aqueous pulp suspension uniformly across the machine onto a continuous screen or wire 30 that is moving in the machine direction (MD). Headbox 8 includes slice openings through which the pulp suspension is distributed onto screen or wire 30 which comprise a suitable structure such as a mesh for receiving a pulp suspension and allowing water or other materials to drain or leave the pulp suspension. The formation of the paper sheet 12 is influenced by a plurality of linear actuators 3 extending in the cross direction across the sheet 12 of paper being formed. Actuators 3 control the sheet's weight in the cross direction (CD). Sensors located downstream from the actuators measure the properties of the sheet. The feedstock is fed from the head box through a gap or elongated orifice 5 onto a wire section 30. The orifice or gap is a relatively narrow opening that extends across the width of the machine. Weight profile control in such an arrangement is achieved by locally adjusting the position of the slice lip across the machine with motorized linear actuators 3 to vary the dimensions of the gap or orifice immediately adjacent the actuator. As used herein, the "wet end" forming portion of sheetmaking system 10 comprises headbox 8 and wire 30 and those sections before the wire 30, and the "dry end" comprises the sections that are downstream from wire 30.

Sheet 12 then enters a press section 32, which includes multiple press rolls where sheet 12 travels through the openings (referred to as "nips") between pairs of counter-rotating rolls in press section 32. In this way, the rolls in press section 32 compress the pulp material forming sheet 12. This may help to remove more water from the pulp material and to equalize the characteristics of the sheet 12 on both of its sides.

As sheet 12 travels over a series of heated rolls in dryer section 34, more water in sheet 12 is evaporated. A calendar 36 processes and finishes sheet 12, for example, by smoothing and imparting a final finish, thickness, gloss, or other characteristic to sheet 12. Other materials (such as starch or wax) can also be added to sheet 12 to obtain the desired finish. An array of induction heating actuators 24 applies heat along the CD to one or more of the rollers to control the roll diameters and thereby the size of the nips. Once processing by calendar 36 is complete, sheet 12 is collected onto reel 14.

Sheetmaking system 10 further includes an array of steam actuators 20 that controls the amount of hot steam that is projected along the CD. The hot steam increases the paper surface temperature and allows for easier cross direction removal of water from the paper sheet. Also, to reduce or prevent over drying of the paper sheet, paper material 14 is sprayed with water in the CD. Similarly, an array of rewet shower actuators 22 controls the amount of water that is applied along the CD.

In order to control the papermaking process, selected properties of sheet 12 are continuously measured and the papermaking machine 2 adjusted to ensure sheet quality. Typical physical characteristics of paper that are can be measured include, for example, thickness, basis weight, moisture content, chemical composition such as ash, surface roughness, gloss, caliper, color, and crepe pattern surface features. CD control may be achieved by measuring sheet properties using one or more scanners 26, 28 that are capable of scanning sheet 12 and measuring one or more characteristics of sheet 12. For example, scanner 28 could carry sensors for measuring the dry weight, moisture content, ash content, or any other or additional characteristics of sheet 12. Scanner 28 includes suitable structures for measuring or detecting one or more characteristics of sheet 12, such as a set or array of sensors. Scanner 28 is particularly suited for measuring the dry end dry weight and ash content of the paper product.

Measurements from scanners 26 and 28 are provided to control system 4 that adjusts various actuators or operations of papermaking machine 2 that affect machine direction and cross direction characteristics of sheet 12. A machine direction characteristic of sheet 12 generally refers to an average characteristic of sheet 12 that varies and is controlled in the machine direction. In this example, control system 4 is capable of controlling the dry weight of the paper sheet by adjusting the supply of pulp to the headbox 8. For example, control system 4 could provide information to a stock flow controller that regulates the flow of stock through valves and to headbox 8. Control system 4 includes any hardware, software, firmware, or combination thereof for controlling the operation of the sheetmaking machine 2 or other machine. Control system 4 can, for example, include a processor and memory storing instructions and data used, generated, and collected by the processor. CD scanner sheet property measurements are stored for future reference and/or accessed for real-time observation and analysis. Control systems for papermaking machines are described, for instance, in U.S. Pat. No. 9,309,625 to Backstrom and Forbes, U.S. Pat. No. 10,174,456 to Backstrom and Forbes and U.S. Pat. No. 10,358,771 to He et al., which are incorporated by reference.

Figure 2:
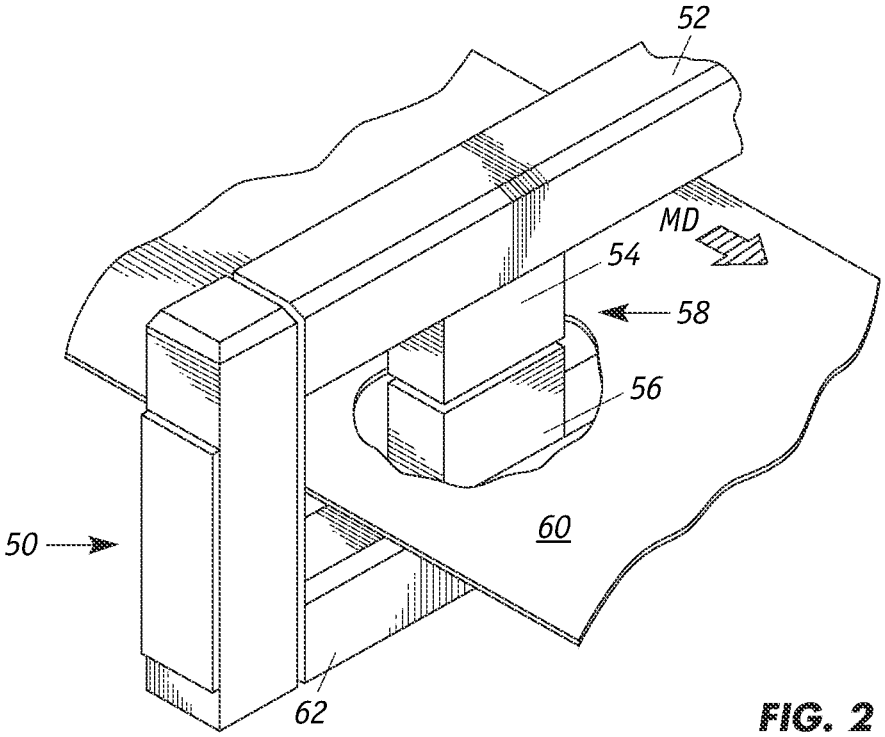
FIG. 2 is a scanning sensor.

FIG. 2 illustrates one particular implementation of the scanning sensor which is located at the dry end just before the take-up reel of FIG. 1. In particular, the radiation source and detector are housed in a dual mounting head scanner 58 of scanner system 50 which can be employed to measure one or more characteristics of the paper that is produced. Upper scanner head 54 moves repeatedly back and forth in the CD across the width of the moving sheet 60, which moves in the MD, so that the characteristics of the entire sheet may be measured. Scanner 58 or gauge is supported by two transverse beams 52 and 62 on which are mounted upper and lower scanning heads 54 and 56, respectively. The operative faces of the lower and upper scanner heads 56, 54 define a measurement gap or window that accommodates sheet 60. The lower scanner head 56 may include a sheet stabilization system such as an air-bearing stabilizer (not shown) to maintain the sheet on a consistent plane as it passes through the measurement window. The movement of the dual scanner heads 54, 56, is synchronized with respect to speed and direction so that they are aligned with each other. The width of the sheet in the CD in industrial can be more than ten meters; typically, in the normal production mode, the scanner heads move at a rate of 0.3 to 0.7 meters per second.

Depending on the properties being monitored, the scanning sensors can be configured to operate in the transmissive mode or reflective mode. For instance, scanner head 54 can house a radiation source that directs a beam of radiation into a moving web or sheet 26 and scanner head 56 houses a radiation receiver that detects radiation that is transmitted through the material. As the dual scanner heads advances back and forth along the CD, the sensor measures one or more properties of the web or sheet 60. Sensors operating in the transmission mode are described, for instance, in U.S. Pat. No. 9,182,360 to Tixier and Hughes, U.S. Pat. No. 8,527,212 to Hughes and Tixier, U.S. Pat. No. 7,298,492 to Tixier, US 2021/0382173 to Hughes et al. and US 2021/0262776 to Tixier and Hughes, which are incorporated herein by reference. Typically, in the normal production mode, the sampling rate of the scanning sensor ranges from one sample every 10 to 200 milliseconds.

In the reflective mode, the upper scanner head 54 can house both a radiation source and detector to measure one or more characteristics of the web or sheet 26. Sensors operating in the reflective mode are described, for instance, in in U.S. Pat. Nos. 9,182,360, 8,527,212, 7,298,492 and US2020/0096308 to Hughes et al, which are incorporated herein by reference.

Cameras can be secured to the upper or lower scanner head to capture surface images of the sheet 60. Cameras, for described, in U.S. Pat. No. 7,695,592 to Shakespeare and Kellomaki, which is incorporated herein by reference.

The moving scanner does not measure the selected sheet property at locations which are aligned exactly perpendicular to the longitudinal edges of moving sheet 60. Instead, because of the sheet velocity, the scanning device travel diagonally across the sheet surface, with the result that consecutive scanning paths have a zig-zag pattern with respect to the direction perpendicular to the longitudinal edges of the sheet.

Figure 3:
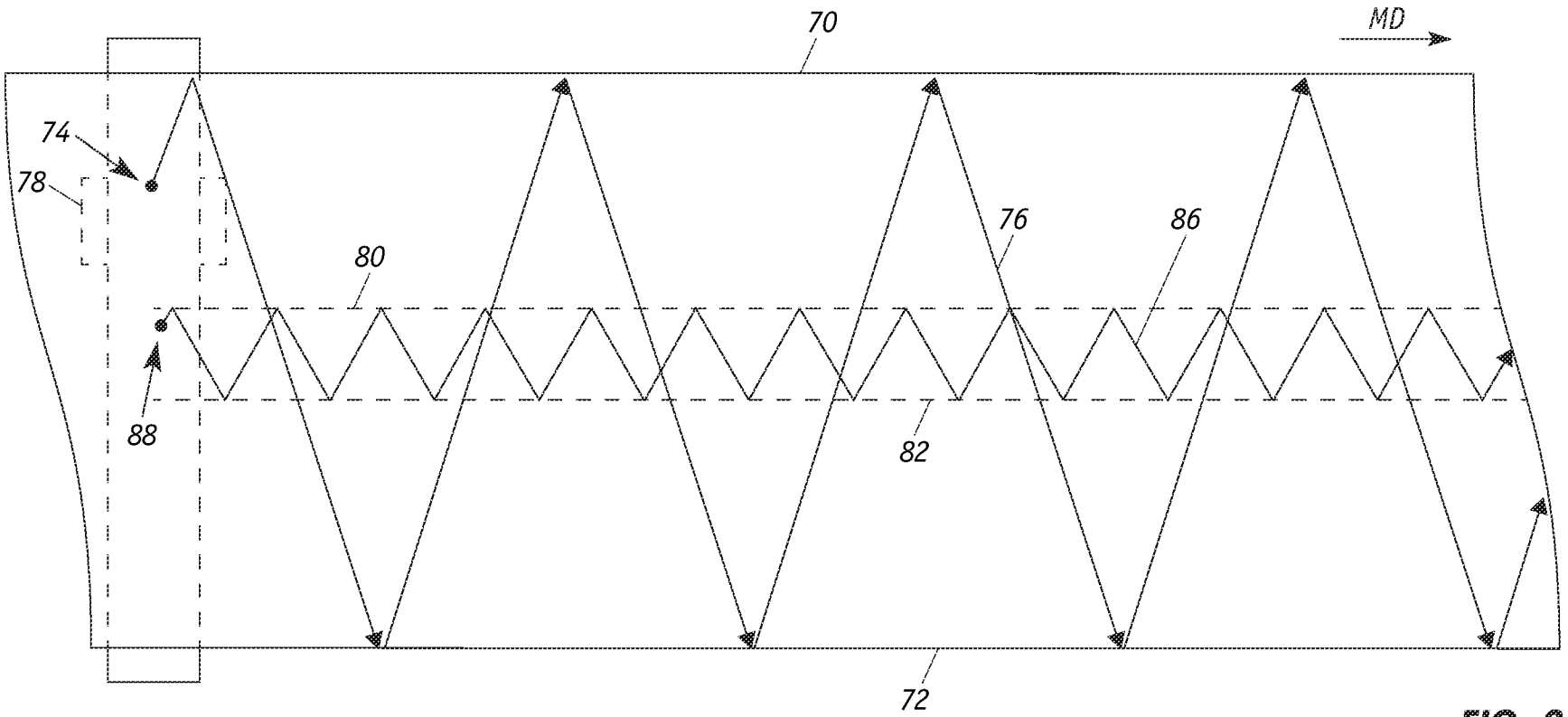
FIG. 3 illustrates scanning patterns.

FIG. 3 illustrates an example of a zig-zag scanning pattern 76 which would be traced during normal operations of a papermaking machine by a gauge as the scanning device 78 traverses the surface of sheet during back-and-forth consecutive scans. The gauge has an interrogation spot 74 and the pattern 76 represents where measurements are made on the moving sheet between edges 70 and 72 of the sheet. The angles of the scanning path relative to the true CD depend upon the cross-directional velocity of the scanning device 78 and upon the machine-directional velocity of the sheet. The zig-zag pattern of interrogation spot 74 covers a relatively small portion of the sheet surface. It should be noted that in actual operations, the scanner 78 decelerates as it approaches an edge of a sheet, stops at the edge and then accelerates as it moves away from the edge towards the center of the sheet. Thus, the zig-zag pattern is actually curved rather than exhibit the sharp corners as illustrated.

In practice, measurement information provided by a scanning sensor is usually assembled after each scan to provide a "profile" of the detected sheet property in the cross direction. In other words, each profile is comprised of a succession of sheet measurements at adjacent locations in the cross direction. The characteristic measurements are averaged in finite sized bins of CD segments. The purpose of the profiles is to allow cross-directional variations in sheet properties to be detected easily. Maps displaying the scanner measurements are typically divided into points or bins across the width; for example, each bin can represent a distance of about 5 mm.

Figure 4:
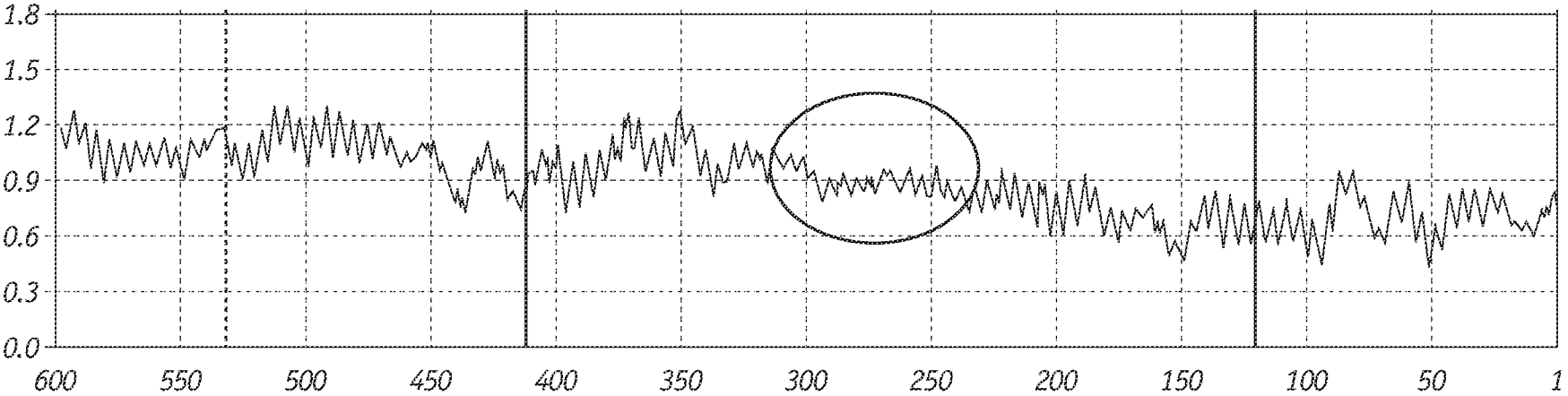
FIG. 4 is a cross directional profile of a sheet characteristics.

FIG. 4 is an illustrative cross directional profile generated by scanner 28 (FIG. 1) that measures a property of the paper at the dry end. The scanner is operating in the production mode which scans the full width the moving sheet from edge to edge. The property levels designated by arbitrary units fluctuate over the width of the paper from bin 1 to 600.

With the present invention, the mini-scan can be conducted anytime to correlate the on-line sensor readings to laboratory tests for verification of accuracy and repeatability. The procedure matches the paper that is being sampled in the laboratory with the corresponding readings from the sensor. In the normal scanning mode, the sensor traverses the entire sheet in x seconds (scan time). Since only a small portion of the sheet is tested, a great deal of time is spent reading paper that is not relevant to the test.

With the mini-scan, the scanning parameters are changed so that the scanner only scans the portion of the sheet that is to be sampled, thereby making all the sensor readings relevant and more likely to be a repeatable result. In practice, an operator reviews the cross directional profile and selects a CD region that exhibits relatively consistent readings. In FIG. 3, a "flat area" that is encircled indicates an area with less variability, which makes it easier to correlate. The length of this CD region for the mini-scan typically will be less than 10% of the CD length for the full-scan and preferably about 2 to 6%. Typically, in the mini-scan, verification mode, the scanner heads move at a rate of 0.3 to 0.7 meters per second and the sampling rate of the scanning sensor ranges from one sample every 10 to 200 milliseconds.

FIG. 3 shows the zig-zag pattern 86 generated during the mini-scan which would be traced during verification operations by a gauge as the scanning device 78 traverses the surface of sheet during back-and-forth consecutive scans within the region defined by borders 80, 82. The gauge has an interrogation spot 88 and the pattern 86 represents where measurements are made on the moving sheet. As is apparent, the mini-scan path contains many for reading on the actual sampled product. The sensor data generated in the mini-scans are averaged and printed and displayed to be used to compare to the laboratory values obtained when testing the samples. During the mini-scan, it is preferable that the scanning sensor's control operations be suspended. That is, it is not necessary to use the signals generated by the scanning sensor to regulate the MD or CD controls as during normal operations because the sheet being measured is only representative of a small portion of the overall product. Otherwise, the papermaking machine can be disrupted by being controlled with a small subset of data.

Mini-scans can be implemented when the take-up reel 14 (FIG. 1) has reached the desired size. Once the mini-scan is complete, the running sheet being produced is transferred to a new spool and the full one is removed for testing. Paper samples are removed from the parts of the sheet that were subject to the mini-scanned and the samples analyzed for caliper, basis weight, ash content and the like.

Mini-scans can also be used to diagnose upstream actuators. For instance, as shown in FIG. 1, the formation of the paper sheet 12 is influenced by a plurality of linear actuators 3 extending in the CD. Actuators 3 control the sheet's weight in the CD. If there is a malfunction of one of the actuators, the effects will be shown in the measurements in scanner 28. A mini-scan at selected narrow segments of the CD can be employed to determine which of the actuators need tuning, adjustment or replacement.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for manufacturing a continuous sheet product that moves in a machine direction (MD), the method comprising:

operating, by a processor, a scanning sensor, in a production mode, to periodically traverse back and forth across a width of a sheet in the cross direction (CD) to detect a first set of values of a selected sheet property;

operating, by the processor, the scanning sensor, in a verification mode, by changing a cross-directional width of each scan to be less than the width of the sheet to detect a second set of values of the selected sheet property, wherein one or more control functions associated with the scanning sensor in the production mode is suspended while the scanning sensor is operating in the verification mode;

identifying, by the processor, one or more actuators that are malfunctioning from a plurality of actuators extending in cross direction of the sheet based on at least the first set of values and the second set of values; and adjusting, by the processor, the one or more identified actuators based on at least the first set of values and the second set of values.

2. The method of claim 1, wherein prior to operating the scanning sensor in the verification mode and during the operation of the scanning sensor in the production mode, the method comprises analyzing a CD profile of the detected values, receiving an input corresponding to selection of a region of the CD profile, wherein the scanning sensor is operated in the verification mode for the selected region of the CD profile.

3. The method of claim 2 wherein the selected region of the CD profile is less than 10% of the width.

4. The method of claim 1 wherein the system is a papermaking machine and the continuous sheet product comprises paper.

5. The method of claim 1 wherein the selected sheet property is selected from the group consisting of thickness, basis weight, moisture content, chemical composition, surface roughness, gloss, caliper, color, crepe pattern surface features and combinations thereof.

6. The method of claim 1 wherein the first set of values and the second set of values detected by the scanning sensor average measurements in finite sized bins of CD segments, wherein the finite sized bins are points on the selected sheet separated by a distance of 5 mm.

7. The method of claim 1 wherein when operating the scanning sensor in production mode, the scanning sensor measures a physical property along a first zig-zag pattern with respect to the sheet of material and when operating the scanning sensor in verification mode, the scanning sensor measures the physical property along a second zig-zag pattern with respect to the sheet of material, wherein the second zig-zag pattern is narrower than the first zig-zag pattern.

8. The method of claim 1 wherein when operating the scanning sensor in verification mode, the detected values are not used to control upstream actuators.

9. A method of operating a continuous sheet making system which includes a plurality of actuators that are positioned along a cross direction (CD) and a scanning sensor, which is positioned downstream of the plurality of actuators, for measuring and acquiring property data of a moving sheet of material, that comprises:

measuring a sheet physical characteristic of the moving sheet of material with the scanning sensor and displaying a cross directional profile of measurements;

selecting a cross directional region within the cross directional profile, wherein the cross directional region has a cross directional width that is less than 10% of the full width of the moving sheet of material;

measuring the sheet physical characteristics of the moving sheet of material with the scanning sensor within the cross directional region;

identifying one or more actuators that are malfunctioning from the plurality of actuators based at least on the sheet physical characteristics; and adjusting the one or more identified actuators based on at least the sheet physical characteristics.

10. The method of claim 9 further comprises adjusting one or more of the plurality of actuators in response to measuring the sheet physical characteristics when the scanning sensor is within the cross directional region.

11. The method of claim 9 wherein when operating the scanning sensor in verification mode, scanning measurements are not used to control upstream actuators.

12. The method of claim 9 wherein when operating the scanning sensor in production mode, the scanning sensor measures a physical property along a first zig-zag pattern with respect to the sheet of material and when operating the scanning sensor in verification mode, the scanning sensor measures the physical property along a second zig-zag pattern with respect to the sheet of material, wherein the second zig-zag pattern is narrower than the first zig-zag pattern.

13. The method of claim 9 wherein selecting a cross directional region within the cross directional profile comprises analyzing the cross directional profile of the measurement and selecting a cross directional region within the profile that exhibits fluctuations in measurements.

14. The method of claim 9 wherein the cross directional region has a cross directional width that is less than 10% of the width of the continuous sheet.

15. A method of measuring process variables in a continuous sheet process which has a machine direction and a cross direction (CD), which comprises:

providing an elongated member that supports a mounting head comprising a sensor;

activating a plurality of actuators to produce a moving sheet of material;

directing the moving sheet of material along a machine direction wherein the sheet has a first edge and a second edge and wherein the elongated member is positioned along a cross direction adjacent to the moving sheet of material;

maneuvering the mounting head back and forth between a first scanning position and a second scanning position such that the sensor measures a property of the sheet between the first edge and the second edge of the sheet of material and the sensor generates first signals corresponding to the measurements;

controlling at least one actuator of the plurality of actuators in response to the first signals;

stop controlling the at least one actuator in response to the first signals;

maneuvering the mounting head back and forth between a third scanning position and a fourth scanning position such that the sensor measures a property of the sheet within a region of the sheet of material that has a cross directional width that is less than 10% of a width of the moving sheet of material and the sensor generates second signals corresponding to the measurements;

obtaining samples of the sheet of material produced during the maneuvering;

analyzing the obtained samples to obtain test results;

comparing the test results to the second signals;

identifying one or more actuators that are malfunctioning from a plurality of actuators extending in cross direction of the sheet based on at least the first set of values and the second set of values; and adjusting the one or more identified actuators based on at least the first set of values and the second set of values.

16. The method of claim 15 wherein when maneuvering the mounting head back and forth between the first scanning position and the second scanning position, the sensor measures a physical property along a first zig-zag pattern with respect to the sheet of material and maneuvering the mounting head back and forth between the third scanning position and the fourth scanning position, the sensor measures the physical property along a second zig-zag pattern with respect to the sheet of material, wherein the second zig-zag pattern is narrower than the first zig-zag pattern.

17. The method of claim 16 wherein the second zig-zag pattern has a cross directional width that is less than 10% of that of the first zig-zag pattern.

18. The method of claim 15 wherein the region of the sheet of material exhibits measurement fluctuations.

* * * * *